US009540709B2

(12) United States Patent
Yang et al.

(10) Patent No.: US 9,540,709 B2
(45) Date of Patent: Jan. 10, 2017

(54) VACUUM REFINING FURNACE

(71) Applicant: Kunming Diboo Technology Co., Ltd., Kunming (CN)

(72) Inventors: Bin Yang, Kunming (CN); Bin Su, Kunming (CN); Jianren Pan, Kunming (CN); Wentong Tang, Kunming (CN); Wei Chen, Kunming (CN); Zefei Fan, Kunming (CN); Wenlin Li, Kunming (CN); Menglin Li, Kunming (CN)

(73) Assignee: Kunming Diboo Technology Co., Ltd., Kunming (CN)

( * ) Notice: Subject to any disclaimer, the term of this patent is extended or adjusted under 35 U.S.C. 154(b) by 329 days.

(21) Appl. No.: 14/218,942

(22) Filed: Mar. 18, 2014

(65) Prior Publication Data

US 2014/0203483 A1 Jul. 24, 2014

Related U.S. Application Data

(63) Continuation-in-part of application No. PCT/CN2011/081087, filed on Oct. 21, 2011.

(30) Foreign Application Priority Data

Oct. 19, 2011 (CN) ..... 2011 1 0318915

(51) Int. Cl.

| | |
|---|---|
| ***C22B 25/08*** | (2006.01) |
| ***C22B 13/06*** | (2006.01) |
| ***C22B 9/04*** | (2006.01) |
| ***F27B 5/04*** | (2006.01) |
| ***F27B 17/00*** | (2006.01) |
| ***F27B 5/06*** | (2006.01) |

(Continued)

(52) U.S. Cl.

CPC . *C22B 9/04* (2013.01); *F27B 5/04* (2013.01); *F27B 5/06* (2013.01); *F27B 5/14* (2013.01); *F27B 17/00* (2013.01); *F27B 17/02* (2013.01); *F27D 7/06* (2013.01); *F27D 11/02* (2013.01); *F27D 2007/066* (2013.01)

(58) Field of Classification Search

CPC ..... C22B 9/04; C22B 13/06; C22B 25/08; F27B 5/04; F27B 5/06; F27B 5/14; F27D 7/06; F27D 7/066

USPC ..... 266/208, 215, 222, 236

See application file for complete search history.

(56) References Cited

U.S. PATENT DOCUMENTS 3,803,335 A * 4/1974 Esjutin ..... F27B 17/00 266/149

4,045,006 A * 8/1977 Cherednichenko ..... C22B 9/04 266/149

* cited by examiner

*Primary Examiner* — Lois Zheng

(74) *Attorney, Agent, or Firm* — Matthias Scholl, PC; Matthias Scholl

(57) ABSTRACT

A vacuum refining furnace, including a furnace body, a graphite heater, an electrode, and a sealed furnace housing. The furnace body includes an evaporation laminate, a graphite condensing casing, and a graphite insulating casing. The evaporation laminate includes a plurality of evaporators. The evaporation laminate is nested within the graphite insulating casing, and the graphite insulating casing includes a plurality of through holes. At least two graphite condensing casings having different diameters are provided. The graphite insulating casing is nested within the graphite condensing casing having a smallest diameter, and the graphite condensing casing having a relatively small diameter is nested within the graphite condensing casing having a relatively large diameter. All the graphite condensing casings except for the graphite condensing casing having the largest diameter include a plurality of through holes.

9 Claims, 6 Drawing Sheets

(51) Int. Cl.

| | |
|---|---|
| ***F27B 5/14*** | (2006.01) |
| ***F27B 17/02*** | (2006.01) |
| ***F27D 11/02*** | (2006.01) |
| *F27D 7/06* | (2006.01) |

VACUUM REFINING FURNACE

CROSS-REFERENCE TO RELATED APPLICATIONS

This application is a continuation-in-part of International Patent Application No. PCT/CN2011/081087 with an international filing date of Oct. 21, 2011, designating the United States, and further claims priority benefits to Chinese Patent Application No. 201110318915.3 filed Oct. 19, 2011. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 14781 Memorial Drive, Suite 1319, Houston, Tex. 77079.

BACKGROUND OF THE INVENTION

Field of the Invention

The invention relates to a vacuum refining furnace.

Description of the Related Art

A typical refining furnace operates to separate and purify non-ferrous alloys based on the different vaporization and condensation properties of different metal elements. The liquid alloy material successively enters different layers of evaporators in the refining furnace, and is heated to a much higher temperature by the graphite heater. During the above process, the metal having low boiling point is transformed from a liquid state to a gas state by evaporation, then condensed to the liquid state again on the graphite condensing casing, and finally collected by a confluence plate. The final liquid is discharged by a discharge pipe while a non-evaporated liquid metal residue is discharged by a residue pipe.

To improve the alloy treatment capacity, conventional refining furnaces are generally equipped with a graphite heater having a much higher power. However, this results in problems such as too high temperature of the graphite condensing casing and a decrease of the condensing efficiency. Some metal vapors requiring a relatively low condensing temperature cannot be condensed and the metal vapors spread randomly, thereby obstructing the exhaust pipe or resulting in short circuit, and shortening the service life of the refining furnace.

SUMMARY OF THE INVENTION

In view of the above-described problems, it is one objective of the invention to provide a vacuum refining furnace having a high yield, high separation efficiency, and low energy consumption. The vacuum refining furnace is capable of purifying and separating multicomponent alloys comprising a Pb—Sn alloy and Pb—Sb—Sn alloy continuously.

In view of the above-described problems, it is one objective of the invention to provide a vacuum refining furnace comprises a furnace body comprising an evaporation laminate, a graphite condensing casing, and a graphite insulating casing. The evaporation laminate is nested within the graphite insulating casing, and the graphite insulating casing comprises a plurality of through holes. At least two graphite condensing casings having different diameters are provided. The graphite insulating casing is nested within the graphite condensing casing having a smallest diameter, and the graphite condensing casing having a relatively small diameter is nested within the graphite condensing casing having a relatively large diameter. All the graphite condensing casings except for the graphite condensing casing having the largest diameter comprise a plurality of through holes.

Design principle of the invention is as follows: the high temperature metal vapor flows from the evaporation laminate and successively exchanges heat with the graphite condensing casings of different layers after passing through the through holes arranged on the graphite insulating casing and the graphite condensing casing. For the metal having a relatively high condensing temperature, the vapor thereof is condensed on the graphite condensing casing disposed relatively close to the evaporation laminate; whereas for the metal having a relatively low condensing temperature, the vapor thereof passes through the through holes of the graphite condensing casing having a relatively small diameter and is condensed on the graphite condensing casing having a relatively large diameter, or even passes through the through holes of a plurality of the graphite condensing casings and is finally condensed on the graphite condensing casing having the largest diameter. A total condensing area within the refining furnace is largely increased after being equipped with a plurality of graphite condensing casings, and the condensing area of each graphite condensing casing varies in an ascending order. The temperature of each graphite condensing casing is progressively decreased in a ladder-type, and the magnitude of the temperature difference is relatively large, thereby being conducive to the separation of at least one metal from the liquid alloy material, broadening the condensable range of the refining furnace, and realizing the refining of the multicomponent alloy. To prevent the temperature of the graphite condensing casing closest to the evaporation laminate from being too high thereby loosing the condensing effect after the refining furnace is provided with the graphite heater having a large power, a graphite insulating casing is disposed between the graphite condensing casing having the smallest diameter and the evaporation laminate. A plurality of the through hole arranged on the graphite are capable of allowing the metal vapor to flow out. The primary functions of the graphite insulating casing are that on one hand the heat quantity from the graphite heater and the evaporation laminate is obstructed, and the temperature of the graphite condensing casing is controlled to be not too high; on the other hand, the temperature of the evaporation laminate is preserved and the evaporation of the liquid alloy material is facilitated. Thus, the heating efficiency and condensation efficiency are enhanced, and the yield is increased under the same energy consumption, so that the refining furnace is capable of condensing a plurality of metals that are difficult to condense, such as antimony, arsenic.

Advantages of the invention are summarized as follows:

1) the power of the graphite heater is up to 450 kW; 2) the refining furnace can treat any proportional Pb—Sn alloy and the lead residue can be controlled at below 5 ppm; 3) the refining furnace can treat a Pb—Sb—Sn alloy comprising equal to or less than 50 wt. % of antimony; 4) the refining furnace can treat a Pb—Sn—Bi alloy, an In—Sn alloy, and a multicomponent alloy comprising more than 96 wt. % of lead, the rest being gold, silver, platinum, rhenium, iridium, copper, antimony, and bismuth; 5) the refining furnace has small heat loss and high evaporating and condensing efficiency; and 6) the refining furnace has a prolonged service life, low energy consumption, high direct yield of the metal, good production environment, and stable and reliable function.

Figure 1:
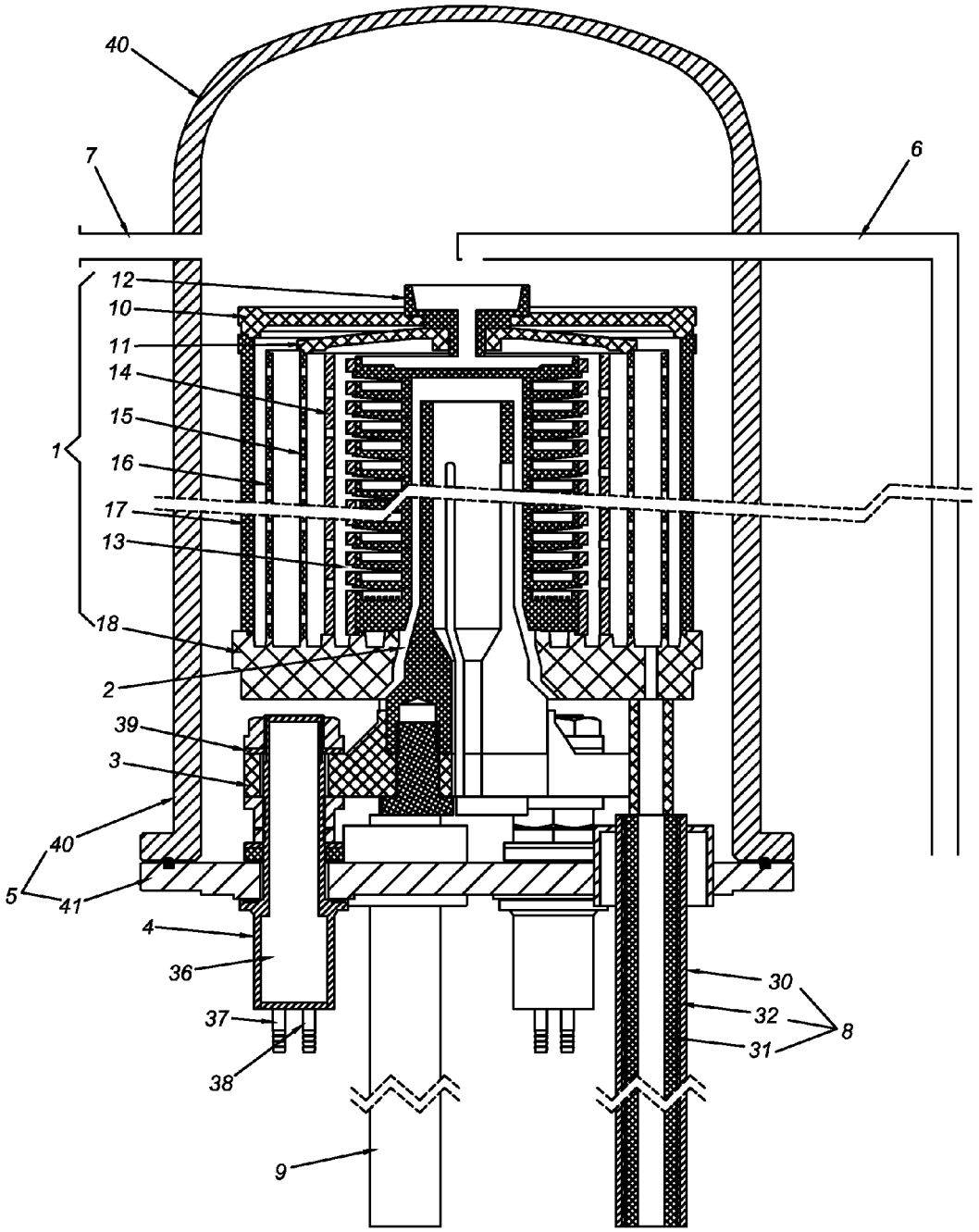
FIG. 1 is a cross-sectional view of a vacuum refining furnace in accordance with one embodiment of the invention.

In the drawings, the following reference numbers are used: 1. Furnace body; 2. Graphite heater; 3. Connecting base of heater; 4. Electrode; 5. Sealed furnace housing; 6. Feed pipe; 7. Exhaust pipe; 8. Discharge pipe; 9. Residue pipe; 10. First graphite condensing cover; 11. Second graphite condensing cover; 12. Graphite feed hopper; 13. Evaporation laminate; 14. Graphite insulating casing; 15. First condensing casing; 16. Second graphite condensing casing; 17. Third graphite condensing casing; 18. Confluence plate; 19. Top plate; 20. Bottom plate; 21. Evaporator; 22. Through hole of heater; 23. Evaporation tank; 24. Front of evaporation tank; 25. Rear of evaporation tank; 26. Evaporation tank grate; 27. Material discharge hole; 28. Supporting ring of insulating hoop; 29. Insulating hoop; 30. Steel casing; 31. Graphite liner; 32. Fire-proof filler; 33. Heating pin; 34. Graphite bolt; 35. Positioning member; 36. Liquid cooling cavity; 37. Liquid inlet; 38. Liquid outlet; 39. Stopper piece; 40. Upper cover of furnace housing; and 41. Bottom plate of furnace housing.

DETAILED DESCRIPTION OF THE EMBODIMENTS

For further illustrating the invention, experiments detailing a vacuum refining furnace for nonferrous metal multicomponent alloy are described hereinbelow combined with the drawings.

As shown in FIG. 1, a vacuum refining furnace for nonferrous metal multicomponent alloy, comprises: a furnace body 1, a graphite heater 2, a connecting base 3 of a heater, an electrode 4, a sealed furnace housing 5, a feed pipe 6, an exhaust pipe 7, a discharge pipe 8, and a residue pipe 9, in which:

1) The furnace body 1 comprises a first graphite condensing cover 10, a second graphite condensing cover 11, a graphite feed hopper 12, an evaporation laminate 13, a graphite insulating casing 14, a first condensing casing 15, a second graphite condensing casing 16, a third graphite condensing casing 17, and a confluence plate 18. The evaporation laminate 13 is disposed on a center of the confluence plate 18. The evaporation laminate 13 is nested within the graphite insulating casing 14. The diameters of the first condensing casing 15, the second graphite condensing casing 16, and the third graphite condensing casing 17 are in ascending order. The graphite insulating casing 14 is nested within the first condensing casing 15, the first condensing casing 15 is nested within the second graphite condensing casing 16, and the second graphite condensing casing 16 is nested within the third graphite condensing casing 17. The graphite insulating casing 14, the first condensing casing 15, and the second graphite condensing casing 16 are all provided with a plurality of through holes. The first graphite condensing cover 10 is disposed on the third graphite condensing casing 17. The second graphite condensing cover 11 is disposed on the first condensing casing 15. The graphite feed hopper 12 passes through the first graphite condensing cover 10 and the second graphite condensing cover 11 and is disposed right above an upper part of the evaporation laminate 13.

Figure 2:
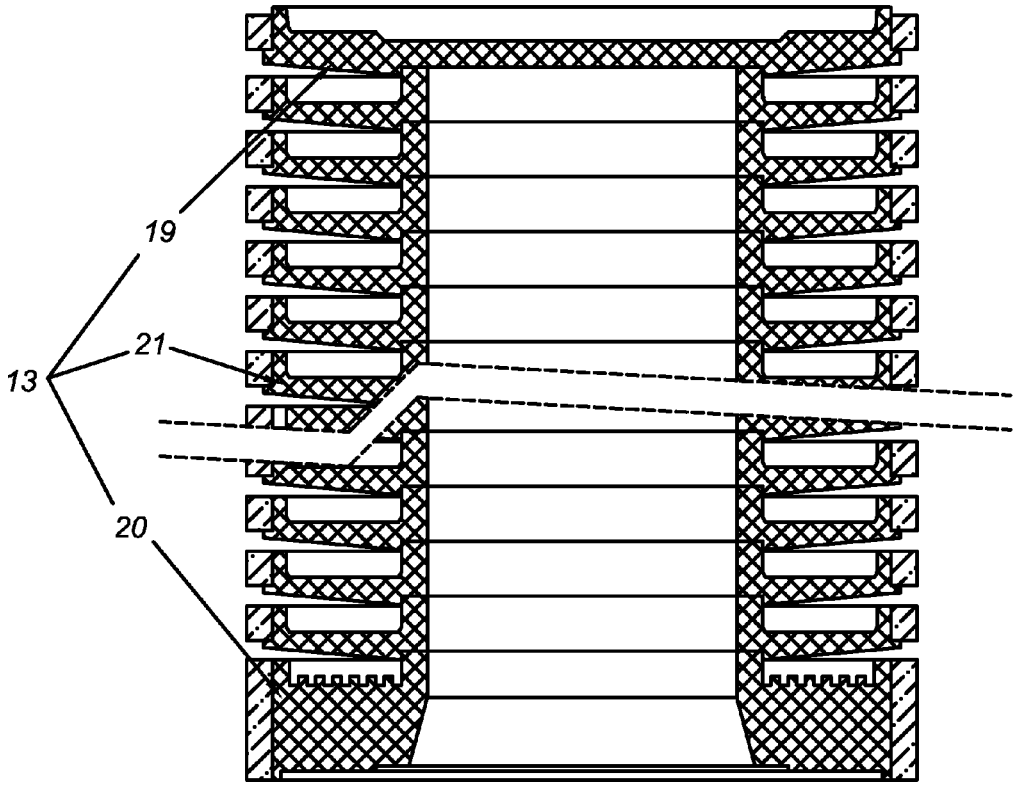
FIG. 2 is a cross-sectional view of an evaporation laminate.
Figure 3:
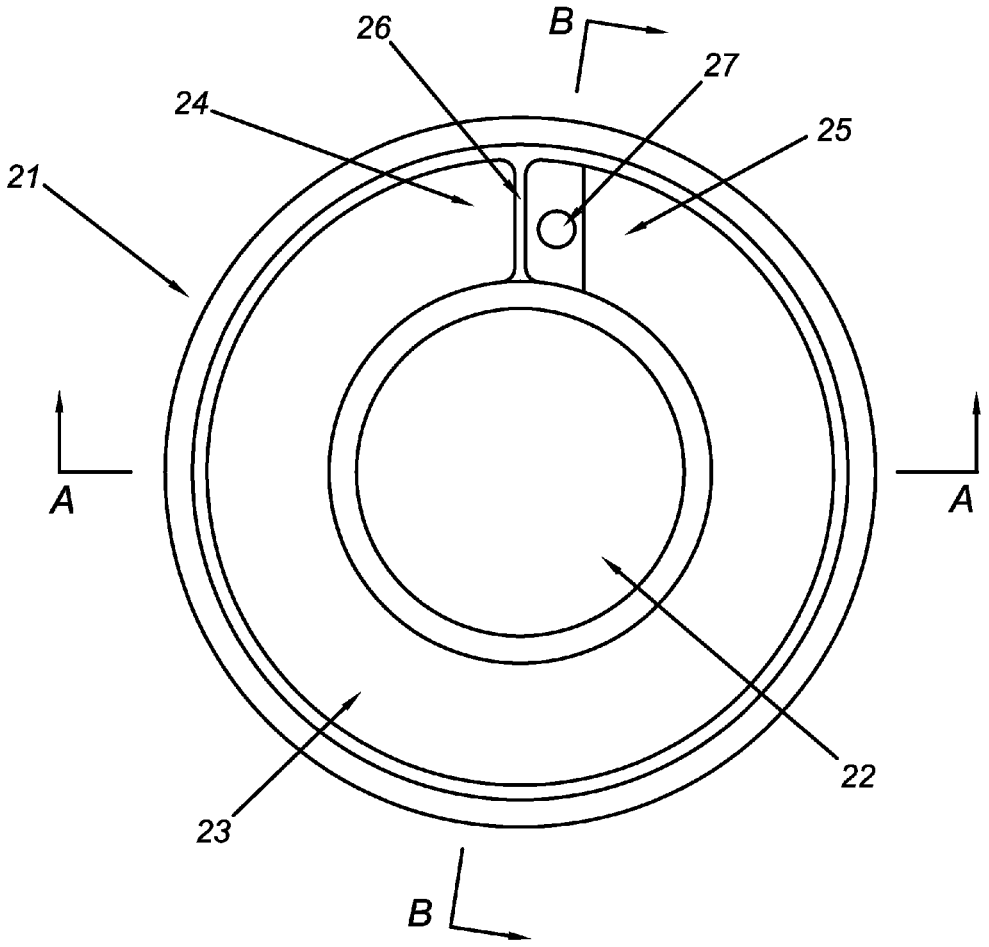
FIG. 3 is a front view of an evaporator.
Figure 4:
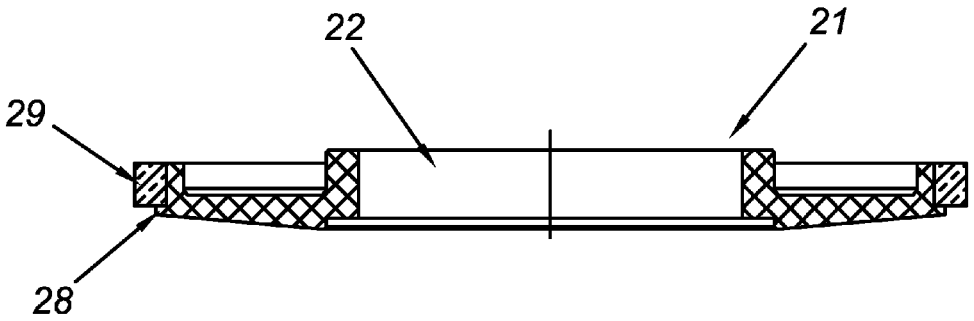
FIG. 4 is a cross-sectional view taken from part A-A of FIG. 3.
Figure 5:
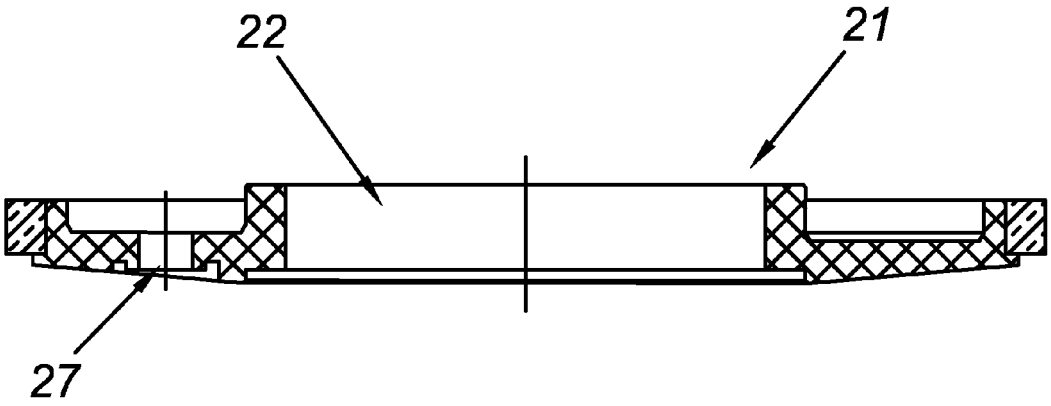
FIG. 5 is a cross-sectional view taken from part B-B of FIG. 3.

As shown in FIG. 2, the evaporation laminate 13 comprises a top plate 19, a bottom plate 20, and a plurality of evaporators 21. The evaporators 21 are disposed between the top plate 19 and the bottom plate 20, and through holes 22 of heaters are disposed on both the bottom plate 20 and the evaporators 21 for allowing the graphite heater 2 to pass through. As shown in FIGS. 3-5, the evaporators 21 are in the shape of a disc. An evaporation tank 23 is circumferentially disposed on the evaporators 21. One end of the evaporation tank 23 is a front 24 of the evaporation tank, and the other end of the evaporation tank is a rear 25 of the evaporation tank. The front 24 of the evaporation tank and the rear 25 of the evaporation tank are separated by an evaporation tank grate 26. The rear 25 of evaporation tank comprises a material discharge hole 27. During the working process, the liquid alloy material falls from the top plate 19 to the front of the evaporation tank on the evaporator of the highest layer, then to the rear of the evaporation tank along the evaporation tank, thereafter flows out from the material discharge hole and falls on the front of evaporation tank of the evaporator of a next layer, and finally falls on the bottom plate 20 after several cycles. As shown in FIG. 4, an insulating hoop 29 is mounted on a sidewall of the evaporator 21 via a supporting ring 28 of insulating hoop. The insulating loop 29 mainly functions in conducting heat preservation on the evaporator 21, ensuring uniformly heating of the liquid alloy material and fixing a circumferential side wall of the evaporator 21. The evaporation tank of the evaporator has a one-way flow channel. Upon assembly, the upper and the lower evaporators are staggered with each other so that the liquid alloy therein has an enough retention time thereby facilitating the heat exchange and evaporation.

A bottom of the bottom plate 20 is connected to the residue pipe 9. The liquid alloy material after high temperature evaporation is discharged from the residue pipe 9. A bottom of the confluence plate 18 is connected to the discharge pipe 8, and the liquid metal after being condensed is discharged via the discharge pipe 8. Because the liquid alloy material after high temperature evaporation or the liquid metal condensed after evaporation is apt to react with both the discharge pipe and the residue pipe made of metal, thus, a newly produced alloy will pollute the product, and meanwhile the discharge pipe or the residue pipe will become thinner or even be perforated. The discharge pipe 8 and the residue pipe 9 employ the following structures: as shown in FIG. 1, a graphite liner 31 is fitted within a steel casing 30, and a fire-proof filler 32 is filled between the steel casing 30 and the graphite liner 31 for binding. The high temperature liquid metal is prevented from contacting with the steel casing of the discharge pipe 8 and the residue pipe 9 of such structures, thereby prolonging the service life thereof.

Figure 6:
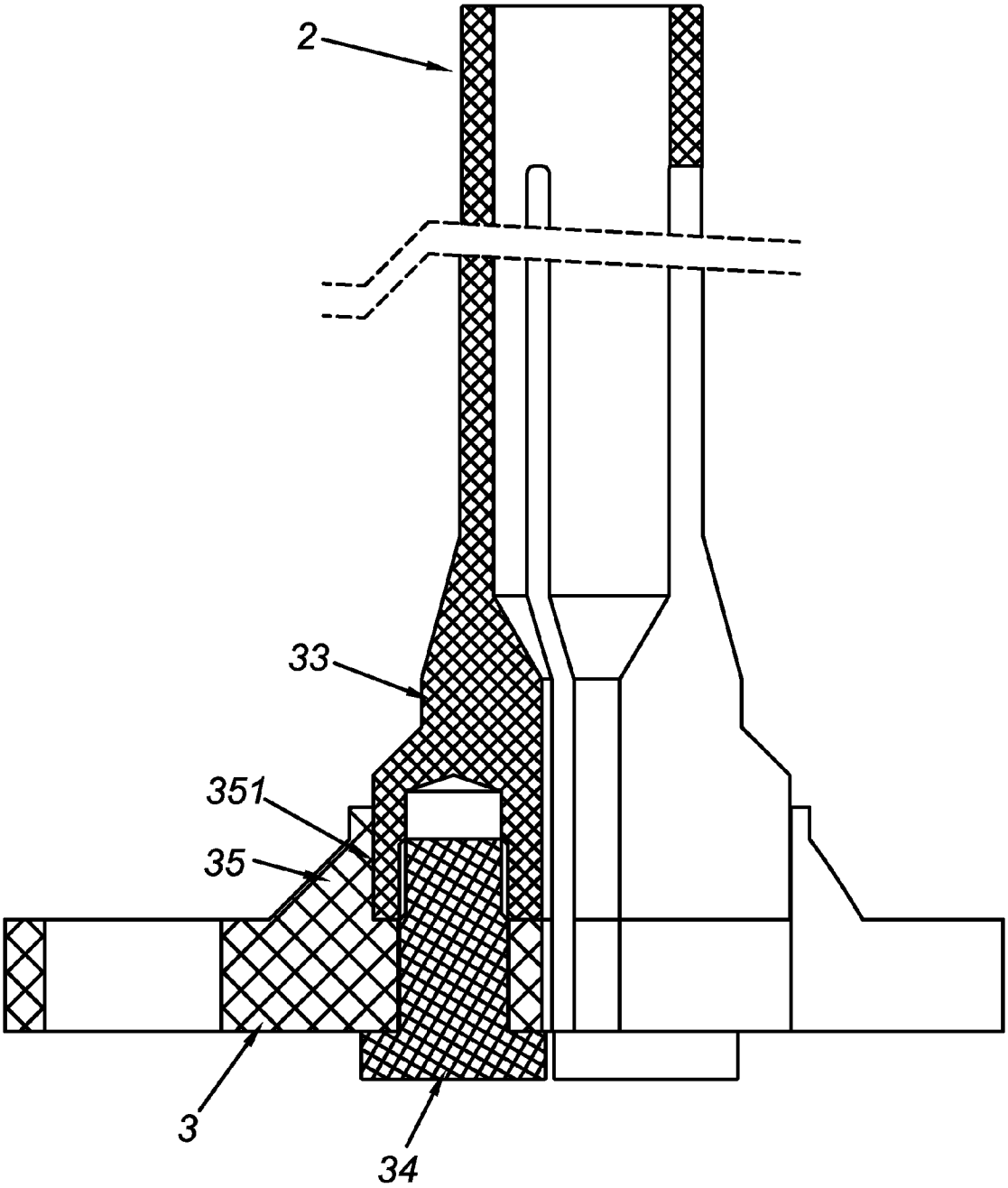
FIG. 6 is a connecting structure diagram between a graphite heater and a connecting base of a heater.

2) As shown in FIG. 6, the graphite heater 2 comprises a heating pin 33. The heating pin 33 and the connecting base 3 are connected via a graphite bolt 34. To position the graphite heater 2, a positioning member 35 is disposed at a position corresponding to the heating pin 33 on the connecting base 3. In order to improve the current carrying capacity between the heating pin 33 and the connecting base 3, the positioning member 35 comprises a contact surface 351 in a vertical direction and the contact surface 351 is attached to a lateral side of the heating pin 33. The lateral side of the heating pin 33 and the contact surface 351 are bonded by a high temperature conductive filler. Therefore, the contact area between the lateral side of the heating pipe and the contact surface are increased, thereby increasing the current carrying capacity and decreasing the contact resistance.

3) As shown in FIG. 1, the graphite heater 2 is connected to the electrode 4 via the connecting base 3. The electrode 4 both functions in supporting the connecting base 3 and the graphite heater 2. When using the graphite heater having a high power easily, a very high temperature of the electrode is easily resulted, thus, the electrode herein is cooled by water cooling method. A liquid cooling cavity 36 is disposed inside the electrode 4. A liquid inlet 37 and a liquid outlet 38 are disposed on an external of the electrode 4 and communicate with the liquid cooling cavity 36. A stopper member is disposed between the connecting base 3 and the electrode 4 for ensuring a stable connection between the connecting base 3 and the electrode 4, and the stopper member is a stopper piece 39.

4) As shown in FIG. 1, the sealed furnace housing 5 is formed by connecting an upper cover 40 of the furnace housing to a bottom plate 41 of furnace housing. The upper cover 40 of the furnace housing is provided with the feed pipe 6 and the exhaust pipe 7, the feed pipe 6 faces the graphite feed hopper 12, and the exhaust pipe 7 is connected to a vacuum extraction device. The electrode 4, the discharge pipe 8, and the residue pipe 9 are all protruded from the bottom plate 41 of the furnace housing and are fixed on the bottom plate 41 of the furnace housing.

EXAMPLE 1

100 tons of a Pb—Sn alloy comprising 5 wt. % of stannum and 95 wt. % of lead was treated in the vacuum refining furnace of the invention. The vacuum degree was controlled at being equal to or less than 10 Pa. The treating capacity was 20 tons per day. After the primary distillation, 9.4 tons of a Sn—Pb alloy comprising 45-50 wt. % of lead and 90.6 tons of lead comprising equal to or less than 0.1 wt. % of stannum were obtained.

EXAMPLE 2

100 tons of a Pb—Sn alloy comprising 70 wt. % of stannum and 30 wt. % of lead was treated in the vacuum refining furnace of the invention. The vacuum degree was controlled at being equal to or less than 10 Pa. The treating capacity was 30 tons per day. After the primary distillation, 74.4 tons of stannum comprising 5-7 wt. % of lead and 25.6 tons of lead comprising equal to or less than 1 wt. % of stannum were obtained.

EXAMPLE 3

100 tons of a Pb—Sn alloy comprising 95 wt. % of stannum and 5 wt. % of lead was treated in the vacuum refining furnace of the invention. The vacuum degree was controlled at being equal to or less than 10 Pa. The treating capacity was 30 tons per day. After the primary distillation, 93 tons of stannum comprising equal to or less than 0.001 wt. % of lead and 7 tons of lead comprising 25-30 wt. % of stannum were obtained.

EXAMPLE 4

100 tons of a Pb—Sb—Sn alloy comprising 42 wt. % of stannum, 40 wt. % of antimony, and 18 wt. % of lead was treated in the vacuum refining furnace of the invention. The vacuum degree was controlled at being equal to or less than 10 Pa. The treating capacity was 20 tons per day. After the primary distillation, 48.4 tons of a Pb—Sb alloy comprising equal to or less than 2 wt. % of stannum and equal to or greater than 60 wt. % of antimony, and 51.6 tons of a Sn—Sb alloy comprising equal to or less than 0.5 wt. % of lead and equal to or less than 20 wt. % of antimony were obtained. Take the Sn—Sb alloy comprising equal to or less than 0.5 wt. % of lead and equal to or less than 20 wt. % of antimony as the material for a secondary distillation, the vacuum degree was controlled at being equal to or less than 10 Pa, and the treating capacity was 10 tons per day. Thereafter, 15.6 tons of a Pb—Sb—Sn alloy comprising 20 wt. % of stannum, 60 wt. % of antimony, and 20 wt. % of lead and 36.4 tons of a crude Sn alloy comprising equal to or less than 1 wt. % of antimony, equal to or less than 0.01 wt. % of lead, and the rest of stannum were obtained.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A vacuum refining furnace, comprising:

a) a furnace body, the furnace body comprising: an evaporation laminate, a plurality of graphite condensing casings, and a graphite insulating casing, and the evaporation laminate comprising a plurality of evaporators;

b) a graphite heater comprising a heating pin;

c) an electrode;

d) a sealed furnace housing;

e) a positioning member; and f) a connecting base;

wherein the evaporation laminate is nested within the graphite insulating casing, and the graphite insulating casing comprises a plurality of through holes;

each of the plurality of graphite condensing casings has a different diameter from another one of the plurality of graphite condensing casings; the graphite insulating casing is nested within the graphite condensing casing having a smallest diameter; each graphite condensing casing except for the graphite condensing casing having the largest diameter is nested within one of the graphite condensing casings; and each graphite condensing casing that is nested within one of the graphite condensing casings has a smaller diameter than the one of the graphite condensing casings it is nested within;

all the graphite condensing casings except for the graphite condensing casing having the largest diameter comprise a plurality of through holes;

the heating pin and the connecting base are connected to each other via a graphite bolt;

the positioning member is disposed on the connecting base;

each of the heating pin, the graphite bolt, and the electrode comprises a side surface;

the positioning member comprises a first side surface and a second side surface;

the connecting base comprises a third side surface and a fourth side surface;

an area of the third side surface is substantially the same as an area of the fourth side surface;

the second side surface, the third side surface, and the fourth side surface are substantially parallel to one another;

the first side surface is disposed between the second side surface and the third side surface and is oblique with respect to the second side surface and the third side surface; and the side surface of the heating pin is in contact with the second side surface of the positioning member, the side surface of the electrode is in contact with the third side surface of the connecting base, and the side surface of the graphite bolt is in contact with the fourth side surface of the connecting base.

2. The furnace of claim 1, wherein the furnace body comprises a first graphite condensing cover, a second graphite condensing cover, a graphite feed hopper, a first graphite condensing casing, a second graphite condensing casing, a third graphite condensing casing, and a confluence plate;

the evaporation laminate is disposed on a center of the confluence plate; the diameters of the first graphite condensing casing, the second graphite condensing casing, and the third graphite condensing casing are in ascending order; the graphite insulating casing is nested within the first graphite condensing casing, the first graphite condensing casing is nested within the second graphite condensing casing, and the second graphite condensing casing is nested within the third graphite condensing casing; and the graphite insulating casing, the first graphite condensing casing, and the second graphite condensing casing are all provided with a plurality of through holes; the first graphite condensing cover is disposed on the third graphite condensing casing; the second graphite condensing cover is disposed on the first graphite condensing casing; the graphite feed hopper passes through the first graphite condensing cover and the second graphite condensing cover and is disposed right above an upper part of the evaporation laminate.

3. The furnace of claim 1, wherein the evaporators are in a shape of a disc; an evaporation tank is circumferentially disposed on the evaporators;

one end of the evaporation tank is a front of evaporation tank, and the other end of the evaporation tank is a rear of evaporation tank;

the front of evaporation tank and the rear of evaporation tank are separated by an evaporation tank grate; and the rear of evaporation tank comprises a material discharge hole.

4. The furnace of claim 1, wherein an insulating hoop is mounted on a sidewall of each of the evaporators via a supporting ring of the insulating hoop.

5. The furnace of claim 1, wherein each of a discharge pipe and a residue pipe comprises a graphite liner and a steel casing, the graphite liner is fitted within the steel casing, and a fire-proof filler is filled between the steel casing and the graphite liner for binding.

6. The furnace of claim 1, wherein the side surface of the heating pin and the second side surface of the positioning member are bonded by a high temperature conductive filler; and the graphite heater has a heating power of 450 kW.

7. The furnace of claim 1, wherein a liquid cooling cavity is disposed inside the electrode, and a liquid inlet and a liquid outlet are disposed on an external of the electrode and communicate with the liquid cooling cavity.

8. The furnace of claim 1, wherein a stopper member is disposed between the connecting base and the electrode.

9. The furnace of claim 8, wherein the stopper member is a stopper piece.

* * * * *